US010065785B2

(12) United States Patent
Genchev

(10) Patent No.: US 10,065,785 B2
(45) Date of Patent: Sep. 4, 2018

(54) DUAL COMPARTMENT MIXING FLUID BOTTLE

(71) Applicant: Mihail Genchev, Tustin, CA (US)

(72) Inventor: Mihail Genchev, Tustin, CA (US)

(73) Assignee: Mihail Genchev, Tustin, CA (US)

( * ) Notice: Subject to any disclaimer, the term of this patent is extended or adjusted under 35 U.S.C. 154(b) by 371 days.

(21) Appl. No.: 15/135,171

(22) Filed: Apr. 21, 2016

(65) Prior Publication Data

US 2016/0311601 A1 Oct. 27, 2016

Related U.S. Application Data

(60) Provisional application No. 62/150,770, filed on Apr. 21, 2015.

(51) Int. Cl.

| | |
|---|---|
| ***B65D 25/08*** | (2006.01) |
| ***B65D 81/32*** | (2006.01) |
| ***A47G 19/22*** | (2006.01) |
| ***B65D 47/06*** | (2006.01) |

(52) U.S. Cl.

CPC ..... *B65D 81/3211* (2013.01); *A47G 19/2205* (2013.01); *A47G 19/2272* (2013.01); *B65D 47/065* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01)

(58) Field of Classification Search

CPC ..... B65D 81/3211; B65D 47/065; B65D 2543/00046; B65D 2543/00092; B65D 2543/00296; B65D 2543/00527; B65D 2543/00537; B65D 25/08; B65D 51/2857; B65D 51/2864; A47G 19/2205; A47G 19/2272

USPC ..... 206/219–222, 568

See application file for complete search history.

(56) References Cited

U.S. PATENT DOCUMENTS

| | | | | | |
|---|---|---|---|---|---|
| 4,886,495 | A * | 12/1989 | Reynolds | A61M 5/284 | 206/222 |
| 5,061,264 | A * | 10/1991 | Scarrow | A61J 1/2089 | 206/221 |
| 5,782,345 | A * | 7/1998 | Guasch | B65D 41/3409 | 206/219 |
| 6,910,573 | B2 * | 6/2005 | Deans | B65D 81/3211 | 206/222 |
| 8,136,660 | B2 * | 3/2012 | Sharon | B65D 81/3205 | 206/221 |
| 8,146,758 | B1 * | 4/2012 | Peres | B65D 81/3205 | 206/219 |
| 8,684,173 | B2 * | 4/2014 | Otsuka | A61J 1/2093 | 206/219 |

(Continued)

*Primary Examiner* — Luan K Bui

(57) ABSTRACT

A sports bottle is designed to mix the components of a sports drink that are stored in separate compartments. The apparatus is configured to resemble a traditional sports bottle. The apparatus includes a pump, a mixing container, a storage container, and a spout. The pump is situated between the pair of containers and is used to transfer a predetermined amount of a sports drink component from the storage container into the mixing container. The mixing container is used to mix the sports drink. The storage container holds the component of the sports drink that will be transferred into the mixing container. The spout enables a user to drink the sports drink retained in the mixing container.

20 Claims, 10 Drawing Sheets

(56) References Cited

U.S. PATENT DOCUMENTS 8,863,948 B2 * 10/2014 Ogawa ..... A61J 1/2093
206/222

* cited by examiner

DUAL COMPARTMENT MIXING FLUID BOTTLE

The current application claims a priority to the U.S. Provisional Patent application Ser. No. 62/150,770 filed on Apr. 21, 2015.

FIELD OF THE INVENTION

The present invention relates generally to a multi-compartment container. More specifically, the present invention is a sports bottle with an extraction mechanism that transfers a discrete volume of an additive material that is stored within one compartment into a separate compartment.

BACKGROUND OF THE INVENTION

Sports drinks are useful tools for keeping athletes operating at their peak level of performance. Often athletes are required to purchase beverages that are premixed with performance enhancing additives. Alternatively, athletes may measure out specific quantities of additive material and then mix it into a beverage. This process requires an athlete to invest time and energy measuring specific quantities of additive material. During this measuring process the athlete may spill some or all of the additive material. Thus, a large quantity of additive material can be wasted over the athlete's life time. Furthermore, relying on human skill often leads to inaccuracy in measurements. Considering these factors, the traditional methods of incorporating additive material into a sports drink leave much to be desired.

Therefore, the objective of the present invention is to provide a bottle that stores fluids and additive material in separate containers. When a user decides to mix the additive material with the stored fluid, the user is able to activate a mechanism that transfers a predetermined quantity of the material into the stored fluid. In this way, the present invention enables users to create sports drinks with concentrations of additive material that are tailored to their unique physiology.

DETAIL DESCRIPTIONS OF THE INVENTION

All illustrations of the drawings are for the purpose of describing selected versions of the present invention and are not intended to limit the scope of the present invention.

Figure 1:
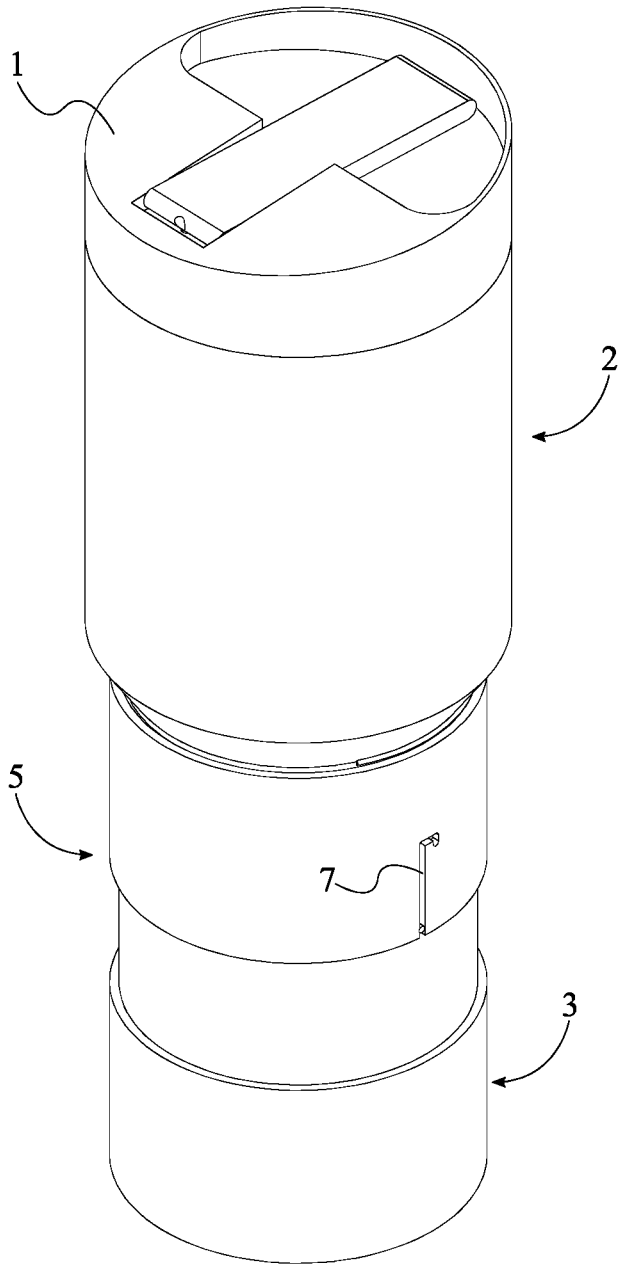
FIG. 1 is an isometric perspective view of the dual compartment mixing fluid bottle.
Figure 2:
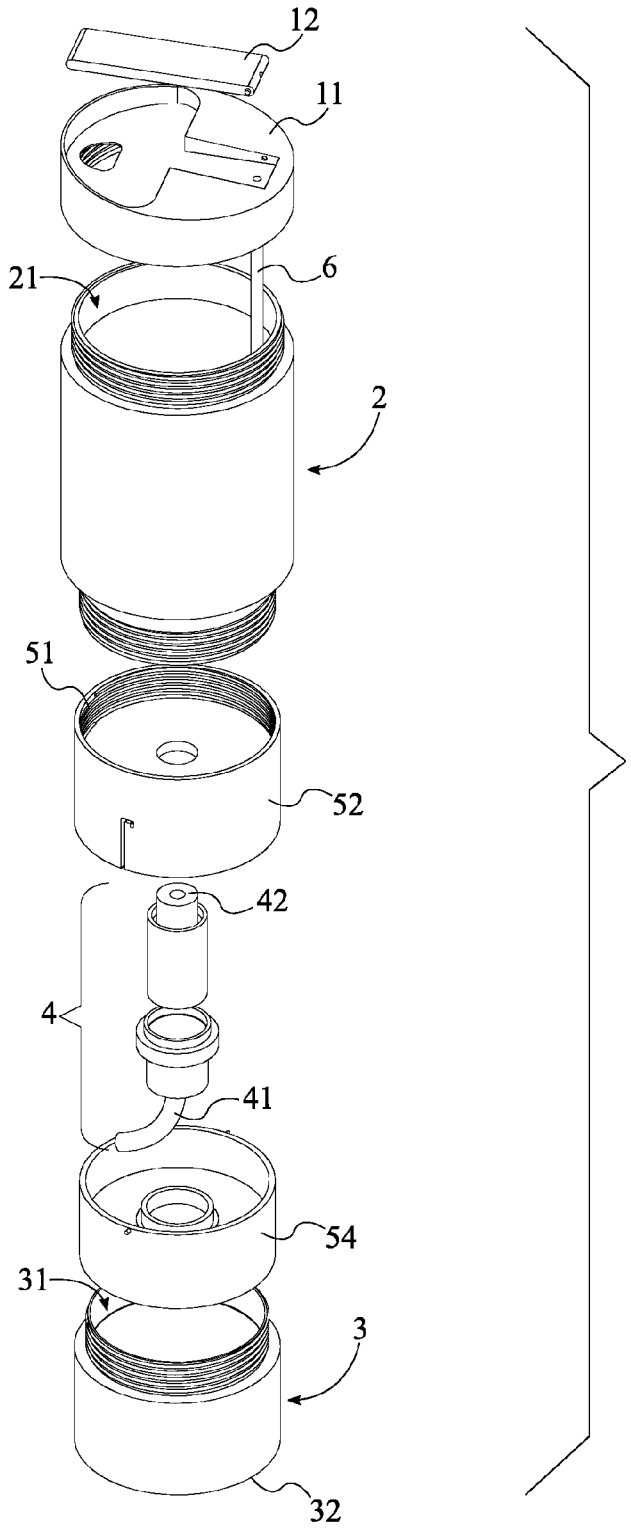
FIG. 2 is an exploded top perspective view of the present invention.
Figure 3:
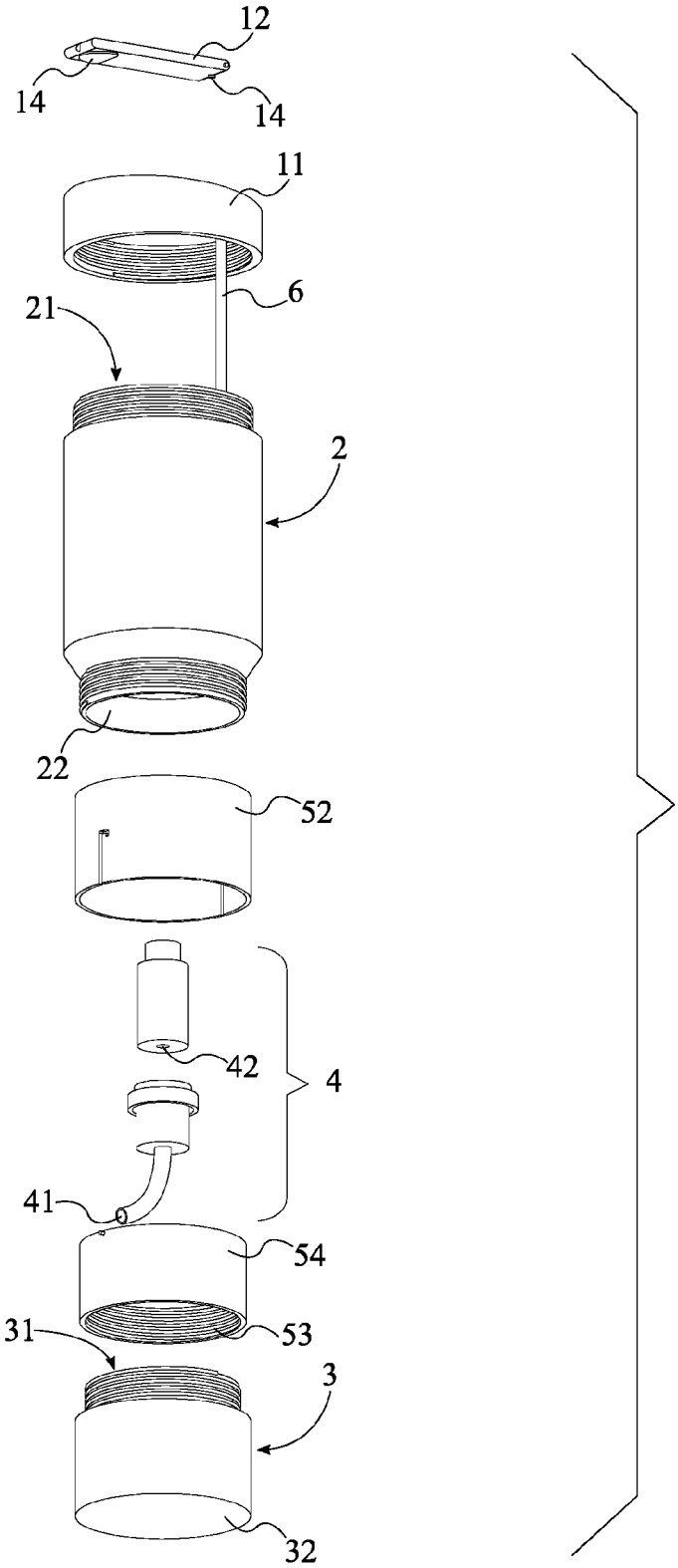
FIG. 3 is an exploded side perspective view of the present invention.
Figure 4:
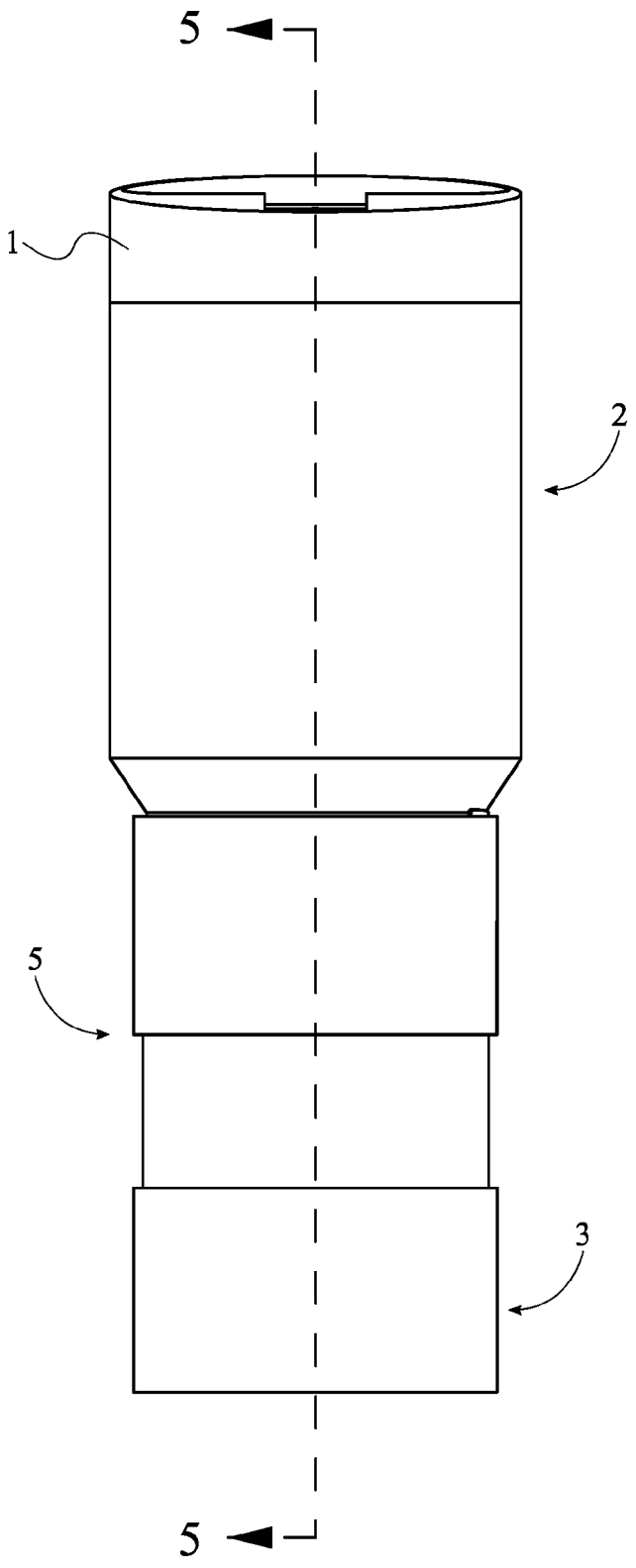
FIG. 4 is a back view of the present invention indicating the direction of the cross-section cut in FIG. 4.

In reference to FIG. 1, FIG. 2, and FIG. 3, the present invention is a dual-compartment mixing bottle that is used to transport discrete quantities of an additive material out of one compartment and into another compartment. In its preferred embodiment the present invention is configured as a sports water bottle, which transports the additive material in one compartment into a quantity of fluid retained by the other compartment. The present invention comprises a lid 1, a first container 2, a second container 3, an extraction mechanism 4, and an actuation mechanism 5. The first container 2 is a hollow tube with two opposing open ends and is used to retain the material that is transferred out of the second container 3. The lid 1 is used to cap one of the two opposing open ends for the first container 2 and is configured to allow a user to access the contents of the first container 2. The second container 3 is a receptacle with one open end so that the extraction mechanism 4 is able to withdraw discrete quantities of the material retained in the second container 3. In the preferred embodiment, the extraction mechanism 4 only allows one-way transportation of material from the second container 3 into the first container 2. The actuation mechanism 5 allows the user to activate the extraction mechanism 4 and to initiate the process of transporting a discrete quantity of material from the first container 2 to the second container 3. In addition, the actuation mechanism 5 is used as a mount between the first container 2 and the second container 3.

The general configuration of the aforementioned components allows the present invention to effectively and efficiently add discrete amounts of an additive material into a quantity of fluid. In order to describe the general configuration, the first container 2 needs to comprise a lid-receiving open end 21 and an outlet-receiving open end 22, which are the two opposing open ends of the first container 2. The lid 1 is detachably and adjacently connected to the first container 2, at the lid-receiving open end 21, which provides the user with selective access to the contents of the first container 2. Moreover, an outlet 42 of the extraction mechanism 4 traverses through the outlet-receiving open end 22 so that the extraction mechanism 4 is able to dispose the discrete quantity of material from the second container 3 into the contents of the first container 2. Also to describe the general configuration, the second container 3 needs to comprise an inlet-receiving open end 31 and a closed base end 32. An inlet 41 of the extraction mechanism 4 traverses through the inlet-receiving open end 31 and into the second container 3 so that the extraction mechanism 4 is able to withdraw the discrete quantity of material from the second container 3. The present invention is also able to rest on the closed base end 32 in an upright position.

For the general configuration, the actuation mechanism 5 is mechanically integrated into the extraction mechanism 4 so that the actuation mechanism 5 can be used to activate the extraction mechanism 4. In addition, the actuation mechanism 5 needs to comprise a first interface 51 and a second interface 53, which act as respective mounting points for the first container 2 and the second container 3. Thus, the first interface 51 is detachably and adjacently connected to the first container 2, at the outlet-receiving open end 22, in order to seal 14 off the first container 2. In addition, the second interface 53 is detachably and adjacently connected to the second container 3, at the inlet-receiving open end 31, in order to seal 14 off the second container 3.

Figure 6:
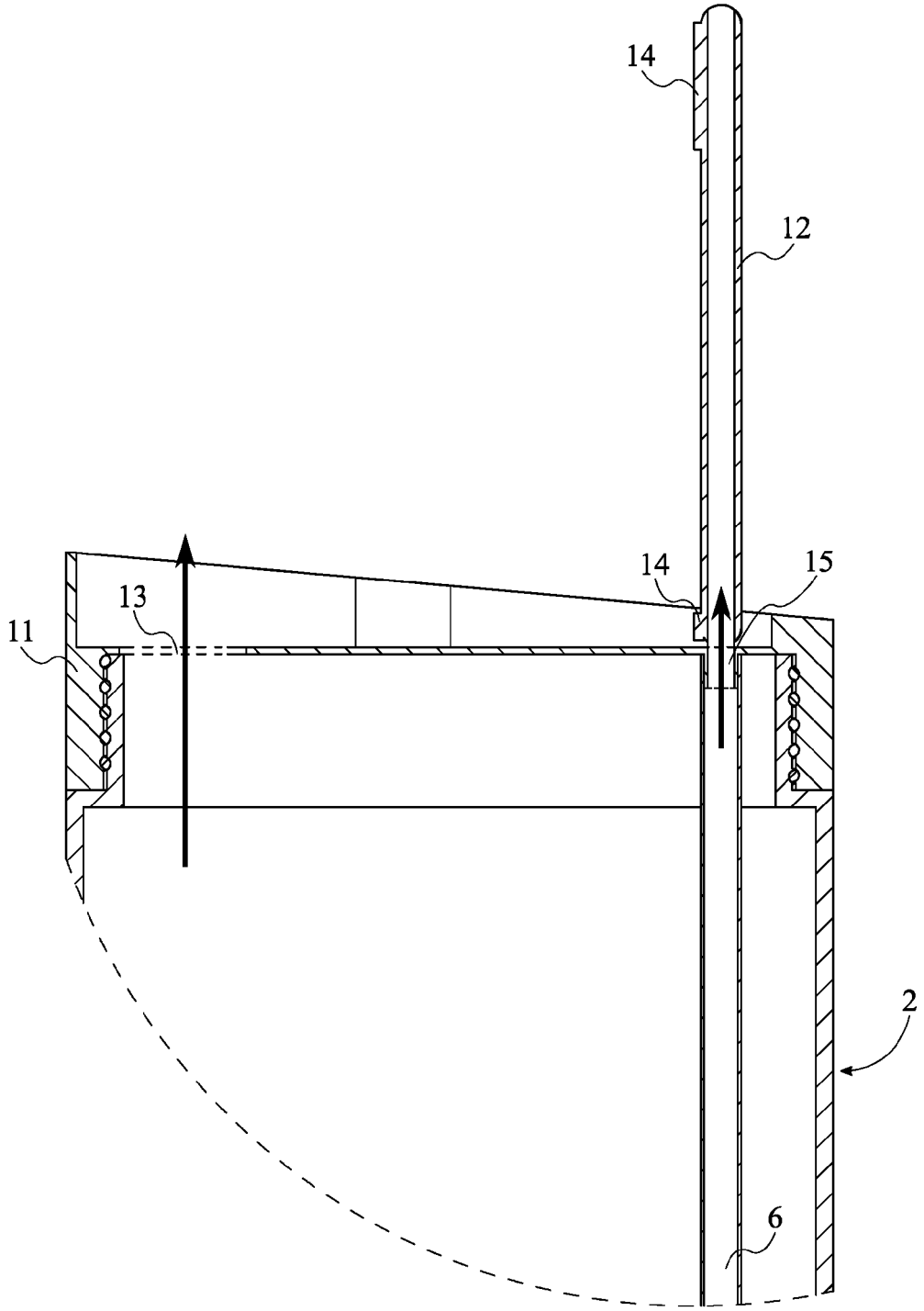
FIG. 6 is a magnified cross-sectional view of the present invention. The flow lines illustrate that the straw is in fluid communication with the lid transfer channel and the spout while the spout is in an open configuration. Additionally, the mouthpiece hole is in fluid communication with the interior of the first container while the spout is in an open configuration.
Figure 7:
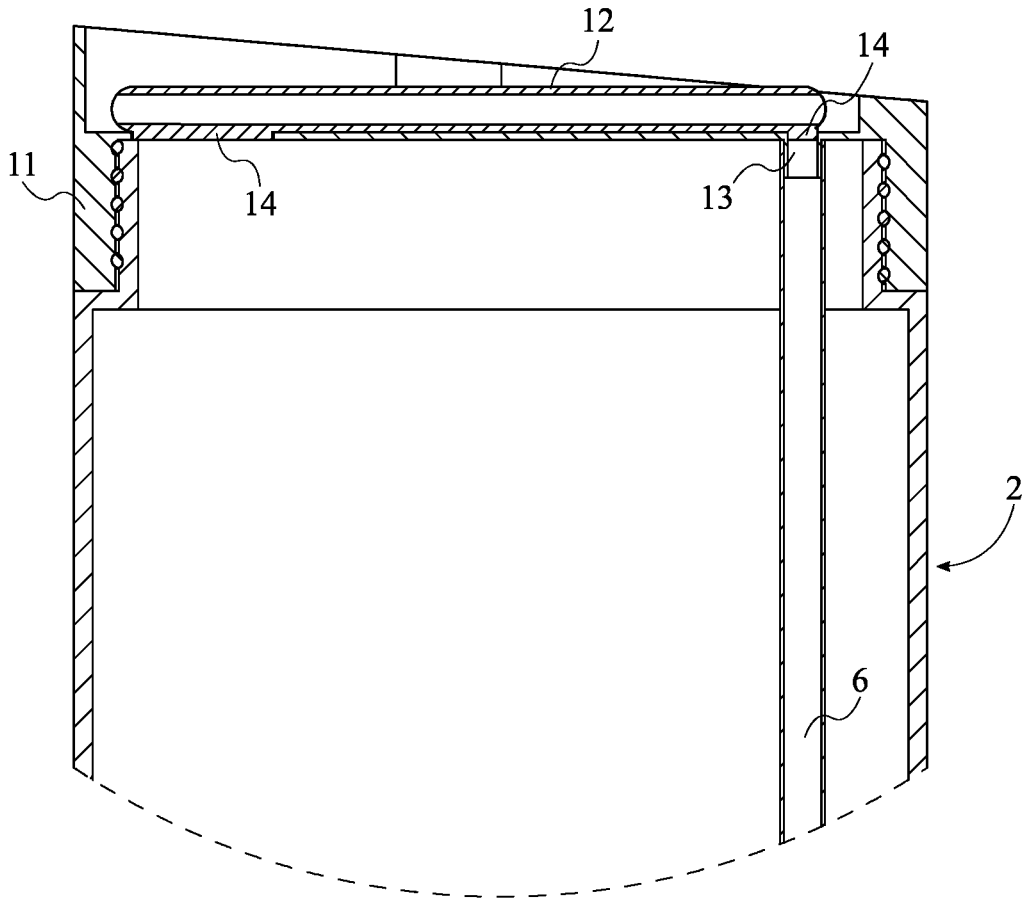
FIG. 7 is a magnified cross-sectional view of the present invention. The seal is pressed into the lid transfer channel and the mouthpiece hole while the spout is in an open configuration.

In reference to FIG. 6 and FIG. 7, in a supplementary embodiment of the present invention, the lid 1 is a mouthpiece used to draw out the fluid retained within the first container 2. In this embodiment, the lid 1 comprises a main body 11, a spout 12, a mouthpiece hole 13, a seal 14, and a lid transfer channel 15. The main body 11 is the structural base of the lid 1 that provides its overall shape so that the spout 12 is able to be connected to the lid 1. In addition, a user's mouth comes into contact with the main body 11 when drinking a fluid through the mouthpiece hole 13. The spout 12 is a reconfigurable conduit used to funnel fluids out of the first container 2 and into a user's mouth. To accomplish this, the spout 12 is hingedly and adjacently connected to the main body 11, opposite the lid-receiving open end 21 so that the user is able to move the spout 12 between an open configuration and a closed configuration. The mouthpiece hole 13 traverses through the main body 11 towards the first container 2 in order to provide a pathway for a fluid retained within the first container 2 to exit the first container 2 through the main body 11. The lid transfer channel 15 traverses through the main body 11 towards the first container 2 so that the spout 12 is in fluid communication with the first container 2, while in the open configuration. The seal 14 is a stopper that is layered along the spout 12 and becomes pressed into the mouthpiece hole 13 and the lid transfer channel 15 when the spout 12 is in the closed configuration. In this way, the seal 14 prevents the fluid retained within the first container 2 from spilling out through the mouthpiece hole 13 and the lid transfer channel 15 while the spout 12 is in the closed configuration. The mouthpiece hole 13 and the lid transfer channel 15 are positioned opposite each other about the main body 11 so that a user is able to selectively drink the fluid stored within the first container 2 through the spout 12 or the mouthpiece hole 13.

In the aforementioned supplementary embodiment of the present invention, the straw 6 is a hollow tube that is opened on both ends and facilitates moving fluid retained within the first container 2 towards the spout 12. The straw 6 is positioned within the first container 2 so that one of its open ends is submerged within the fluid retained within the first container 2. In addition, the opposite end of the straw 6 is detachably and adjacently connected to the main body 11 in order to maintain the straw 6 in fluid communication with the lid transfer channel 15. In this configuration, the fluid retained within the first container 2 travels through the straw 6, into the lid transfer channel 15, and exits the spout 12 as a user draws the fluid into the user's mouth when drinking.

In the aforementioned supplementary embodiment, the spout 12 can be moved into a closed configuration that prevents the fluid retained within the first container 2 from exiting while the lid 1 is connected to the lid-receiving open end 21. As can be seen in FIG. 7 in this configuration, the spout 12 is situated along the main body 11 so that the user does not have access to the lid transfer channel 15 and the mouthpiece hole 13. In addition, the seal 14 is pressed into the lid transfer channel 15 and the mouthpiece hole 13 so that fluids are prevented from passing through either the lid transfer channel 15 or the mouthpiece hole 13.

In the aforementioned supplementary embodiment, the spout 12 can be moved into an open configuration that enables a user to drink the fluid retained within the first container 2. In the open configuration, shown in FIG. 6, the spout 12 is angularly offset from the main body 11 so that a user may pour out the fluid retained within the first container 2 through the mouthpiece hole 13. In addition, the spout 12 is in fluid communication with the lid transfer channel 15 so that a user is able to draw fluid out of the first container 2 through the spout 12.

Figure 8:
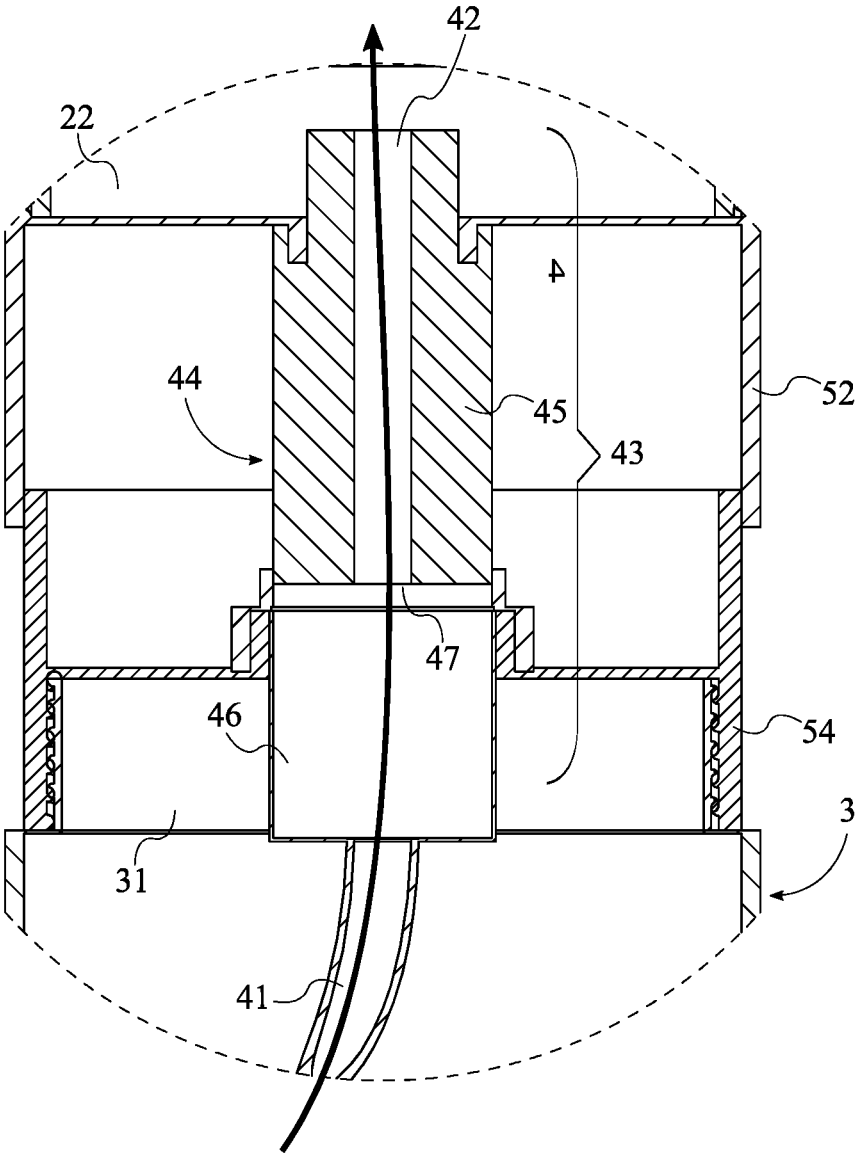
FIG. 8 is a magnified cross-sectional view of the present invention. The flow lines illustrate that the inlet is in fluid communication with the outlet through the push pump.
Figure 9:
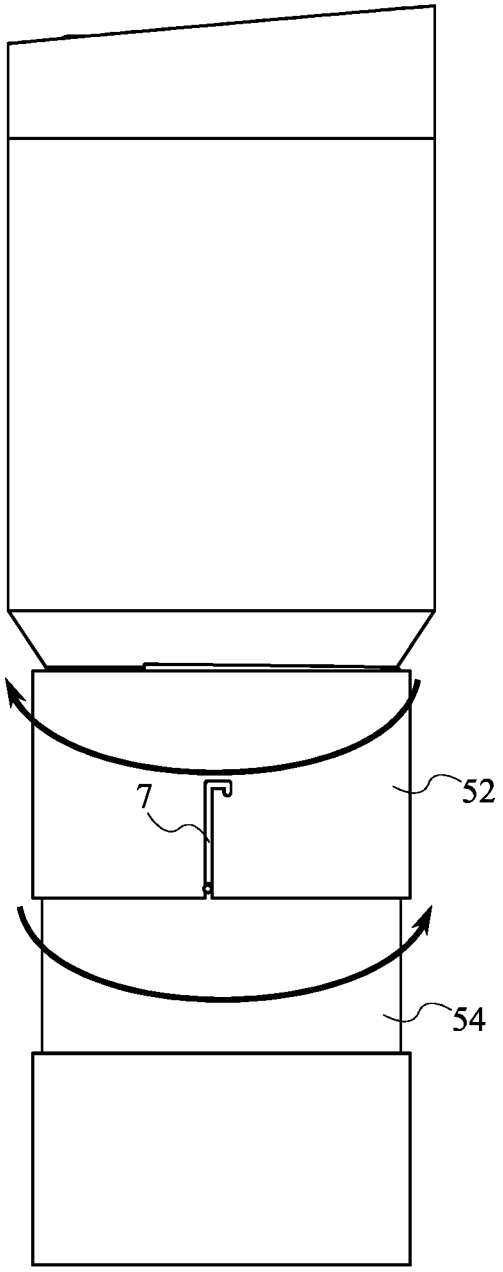
FIG. 9 is a left-side view of the present while the twist locking mechanism is unlocked. The rotational lines indicate the direction the first sleeve and second sleeve must be twisted to engage the twist locking mechanism.
Figure 10:
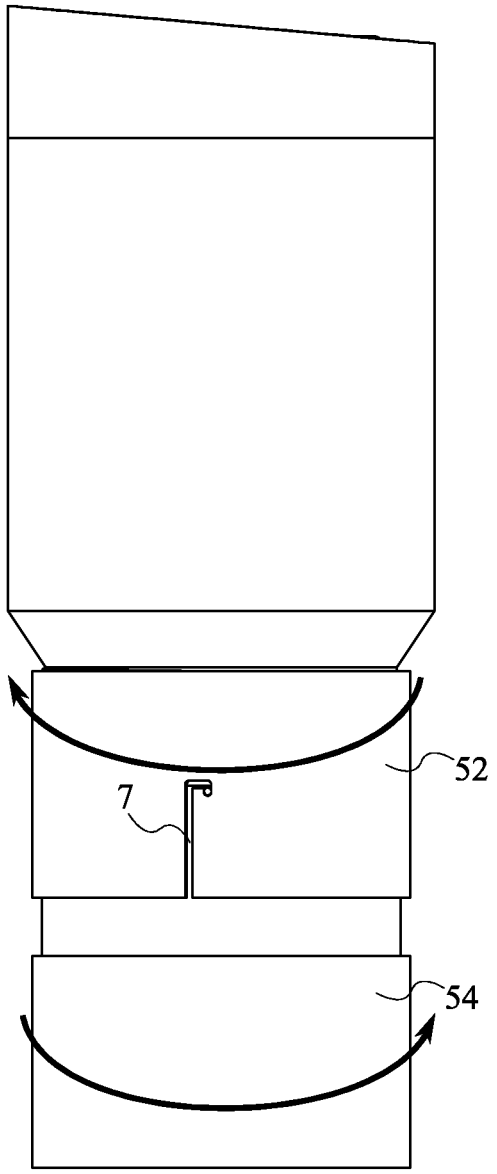
FIG. 10 is a left-side view of the present while the twist locking mechanism is locked. The rotational lines indicate the direction the first sleeve and second sleeve must be twisted to disengage the twist locking mechanism.

In reference to FIG. 8, in some embodiments of the present invention, the extraction mechanism 4 further comprises a pump 43 that is used to withdraw draw a discrete quantity of additive material retained within the second container 3 through the inlet 41 and then push the discrete quantity of additive material out of the outlet 42 and into the first container 2. In these embodiments, the inlet 41 and the outlet 42 are in fluid communication with each other through the pump 43 so that the actuation mechanism 5 activates the pump 43 to initiate fluid transport into the inlet 41, through the pump 43, and out of the outlet 42. In a separate embodiment, the extraction mechanism 4 further comprises a scooping mechanism that shovels a discrete quantity of dry or powdered additive material that is retained within the second container 3 into the inlet 41 and then deposits the gathered discrete quantity of additive material into the first container 2 through the outlet 42. In addition, this scooping mechanism is activated by the actuation mechanism 5 so that a user is able to initiate the transport of a discrete quantity of additive material out of the second container 3 and into the first container 2 by passing the discrete quantity of additive material through the extraction mechanism 4.

In the preferred embodiment of the present invention, the actuation mechanism 5 is a telescopic assembly of sleeves that are slidably engaged into each other so that sliding the sleeves of the actuation mechanism 5 activates the extraction mechanism 4. More specifically, the actuation mechanism 5 further comprises a first sleeve 52 and a second sleeve 54. The first sleeve 52 is telescopically engaged into the second sleeve 54 so that the sliding motion of the two sleeves activates the extraction mechanism 4, causing a discrete quantity of the additive material retained within the second container 3 to be transferred into the first container 2. In addition, the first interface 51 is positioned opposite the second sleeve 54 along the first sleeve 52 so that the first sleeve 52 may be detachably connected to the first container 2, at the outlet-receiving open end 22. Similarly, the second interface 53 is positioned opposite the first sleeve 52 along the second sleeve 54 so that the second sleeve 54 may be detachably connected to the second container 3, at the inlet-receiving open end 31.

Figure 5:
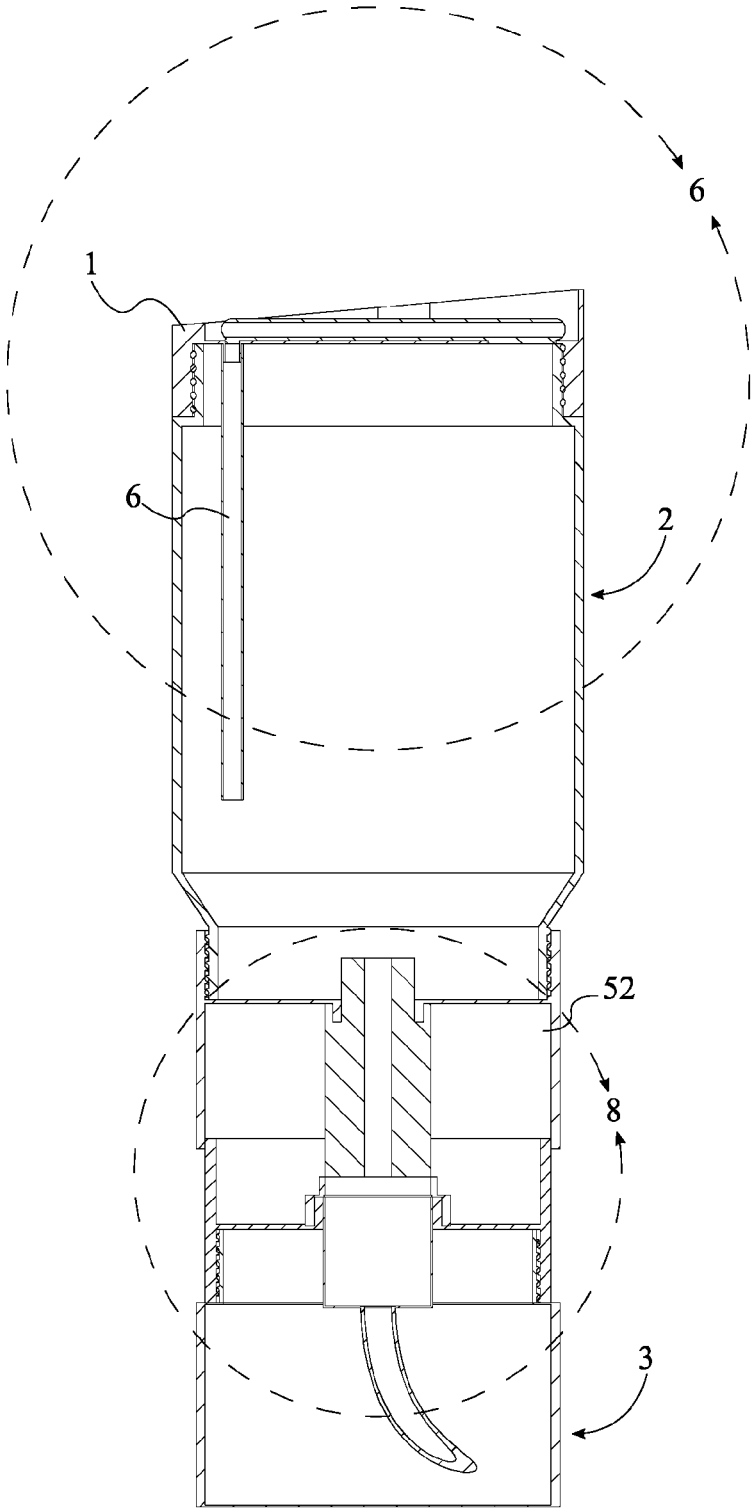
FIG. 5 is a left-side cross-sectional view of section of the present invention indicating the magnified areas in FIG. 6 and FIG. 8.

In reference to FIG. 5 and FIG. 8, in the preferred embodiment of the present invention, the extraction mechanism 4 further comprises a push pump 44 that is activated by the telescoping motion of the actuation mechanism 5 to transfer a discrete quantity of additive material out of the second container 3 and into the first container 2. In the preferred embodiment, the push pump 44 comprises a plunger 45, a fluid transfer chamber 46, and a one-way valve 47. The first sleeve 52 is fixed about the plunger 45 so that the linear motion of the first sleeve 52 is transferred to the plunger 45 which is slidably engaged into the fluid transfer chamber 46. Similarly, the second sleeve 54 is fixed about the fluid transfer chamber 46 so that linear motion of the second sleeve 54 is transferred to the fluid transfer chamber 46. The inlet 41 is in fluid communication with the fluid transfer chamber 46 so that additive material may flow out of the second container 3, through the inlet 41, and into the fluid transfer chamber 46. In addition, the outlet 42 is in fluid communication with the fluid transfer chamber 46 through the one-way valve 47, so that the fluid drawn into the fluid transfer chamber 46 is prevented from flowing back into the second container 3. Moreover, the telescoping motion of the actuation mechanism 5 forces the plunger 45 into and then out of the fluid transfer chamber 46. As the plunger 45 is forced into the fluid transfer chamber 46, the discrete quantity of fluid retained within the fluid transfer chamber 46 is pushed through the outlet 42 and into the first container 2. Conversely, as the plunger 45 is forced out of the fluid transfer chamber 46 a discrete quantity of fluid is pulled through the inlet 41, past the one-way valve 47, and into the fluid transfer chamber 46.

In reference to FIG. 8, the preferred embodiment of the present invention comprises a twist locking mechanism 7 that is used to prevent the telescoping motion of the first sleeve 52 and the second sleeve 54 while the twist locking mechanism 7 is engaged. The twist locking mechanism 7 is operatively integrated between the first sleeve 52 and the second sleeve 54, so that the twist locking mechanism 7 locks the first sleeve 52 and the second sleeve 54. While locked the twist locking mechanism 7 prevents the telescoping motion of the first sleeve 52 into the second sleeve 54. The first sleeve 52 and the second sleeve 54 are locked in place by rotating the twist locking mechanism 7 in one direction. Moreover, the twist locking mechanism 7 unlocks the first sleeve 52 and the second sleeve 54 from each other by rotating the twist locking mechanism 7 in an opposite direction.

Although the invention has been explained in relation to its preferred embodiment, it is to be understood that many other possible modifications and variations can be made without departing from the spirit and scope of the invention as hereinafter claimed.

What is claimed is:

1. A container for mixing two stored fluids comprises:
- a lid;
- a first container;
- a second container;
- an extraction mechanism;
- an actuation mechanism;
- the first container comprises a lid-receiving open end and an outlet-receiving open end;
- the second container comprises an inlet-receiving open end and a closed base end;
- the extraction mechanism comprises an inlet and an outlet;
- the actuation mechanism comprises a first interface and a second interface;
- the lid being detachably and adjacently connected to the first container, at the lid-receiving open end;
- the first interface being detachably and adjacently connected to the first container, at the outlet-receiving open end;
- the outlet traversing through the outlet-receiving open end and into the first container;
- the second interface being detachedly and adjacently connected to the second container at the inlet-receiving open end;
- the inlet traversing through the inlet-receiving open end and into the second container; and
- the actuation mechanism being mechanically integrated into the extraction mechanism, wherein the actuation mechanism is used to activate the extraction mechanism.

2. The container for mixing two stored fluids as claimed in claim 1 comprises:
- the lid comprises a main body, a spout, a mouthpiece hole, a seal, and a lid transfer channel;
- the spout being hingedly and adjacently connected to the main body, opposite the lid receiving open end;
- the mouthpiece hole traversing through the main body towards the first container;
- the seal being layered onto and along the spout;
- the lid transfer channel traversing through the main body towards the first container; and
- the mouthpiece hole and the lid transfer channel being positioned opposite to each other about the main body.

3. The container for mixing two stored fluids as claimed in claim 2 comprises:
- a straw;
- the straw being positioned within the first container;
- the straw being detachably and adjacently connected to the main body; and
- the straw being in fluid communication with the lid transfer channel.

4. The container for mixing two stored fluids as claimed in claim 2 comprises:
- wherein the spout is in a closed configuration;
- the spout being situated along the main body; and
- the seal being pressed into the lid transfer channel and the mouthpiece hole.

5. The container for mixing two stored fluids as claimed in claim 2 comprises:
- wherein the spout is in an open configuration;
- the spout being angularly offset from the main body; and
- the spout being in fluid communication with the lid transfer channel.

6. The container for mixing two stored fluids as claimed in claim 1 comprises:
- the extraction mechanism further comprises a pump; and
- the inlet and the outlet being in fluid communication with each other through the pump.

7. The container for mixing two stored fluids as claimed in claim 1 comprises:
- the actuation mechanism further comprises a first sleeve and a second sleeve;
- the first sleeve being telescopically engaged into the second sleeve;
- the first interface being positioned opposite to the second sleeve along the first sleeve; and
- the second interface being positioned opposite to the first sleeve along the second sleeve.

8. The container for mixing two stored fluids as claimed in claim 7 comprises:
- the extraction mechanism further comprises a push pump;
- the push pump comprises a plunger, a fluid transfer chamber, and a one-way valve;
- the first sleeve being fixed about the plunger;
- the plunger being slidably engaged into the fluid transfer chamber;
- the second sleeve being fixed about the fluid transfer chamber;
- the inlet being in fluid communication with the fluid transfer chamber; and
- the outlet being in fluid communication the fluid transfer chamber through the one-way valve.

9. The container for mixing two stored fluids as claimed in claim 7 comprises:

a twist locking mechanism; and the twist locking mechanism being operatively integrated between the first sleeve and the second sleeve, wherein the twist locking mechanism is used to lock the first sleeve and the second sleeve by rotating the twist locking mechanism in one direction and is used to unlock the first sleeve and the second sleeve by rotating the twist locking mechanism in an opposite direction.

10. A container for mixing two stored fluids comprises:

a lid;

a first container;

a second container;

an extraction mechanism;

an actuation mechanism;

the first container comprises a lid-receiving open end and an outlet-receiving open end;

the second container comprises an inlet-receiving open end and a closed base end;

the extraction mechanism comprises an inlet and an outlet;

the actuation mechanism comprises a first interface, a second interface, a first sleeve and a second sleeve;

the lid being detachably and adjacently connected to the first container, at the lid-receiving open end;

the first interface being detachably and adjacently connected to the first container, at the outlet-receiving open end;

the outlet traversing through the outlet-receiving open end and into the first container;

the second interface being detachedly and adjacently connected to the second container at the inlet-receiving open end;

the inlet traversing through the inlet-receiving open end and into the second container;

the first sleeve being telescopically engaged into the second sleeve;

the first interface being positioned opposite to the second sleeve along the first sleeve;

the second interface being positioned opposite to the first sleeve along the second sleeve; and the actuation mechanism being mechanically integrated into the extraction mechanism, wherein the actuation mechanism is used to activate the extraction mechanism.

11. The container for mixing two stored fluids as claimed in claim 10 comprises:

the lid comprises a main body, a spout, a mouthpiece hole, a seal, a lid transfer channel, and a straw;

the spout being hingedly and adjacently connected to the main body, opposite the lid receiving open end;

the mouthpiece hole traversing through the main body towards the first container;

the seal being layered onto and along the spout;

the lid transfer channel traversing through the main body towards the first container;

the mouthpiece hole and the lid transfer channel being positioned opposite to each other about the main body;

the straw being positioned within the first container;

the straw being detachably and adjacently connected to the main body; and the straw being in fluid communication with the lid transfer channel.

12. The container for mixing two stored fluids as claimed in claim 11 comprises:

wherein the spout is in a closed configuration;

the spout being situated along the main body; and the seal being pressed into the lid transfer channel and the mouthpiece hole.

13. The container for mixing two stored fluids as claimed in claim 11 comprises:

wherein the spout is in an open configuration;

the spout being angularly offset from the main body; and the spout being in fluid communication with the lid transfer channel.

14. The container for mixing two stored fluids as claimed in claim 10 comprises:

the extraction mechanism further comprises a pump; and the inlet and the outlet being in fluid communication with each other through the pump.

15. The container for mixing two stored fluids as claimed in claim 10 comprises:

the extraction mechanism further comprises a push pump;

the push pump comprises a plunger, a fluid transfer chamber, and a one-way valve;

the first sleeve being fixed about the plunger;

the plunger being slidably engaged into the fluid transfer chamber;

the second sleeve being fixed about the fluid transfer chamber;

the inlet being in fluid communication with the fluid transfer chamber; and the outlet being in fluid communication the fluid transfer chamber through the one-way valve.

16. The container for mixing two stored fluids as claimed in claim 10 comprises:

a twist locking mechanism; and the twist locking mechanism being operatively integrated between the first sleeve and the second sleeve, wherein the twist locking mechanism is used to lock the first sleeve and the second sleeve by rotating the twist locking mechanism in one direction and is used to unlock the first sleeve and the second sleeve by rotating the twist locking mechanism in an opposite direction.

17. A container for mixing two stored fluids comprises:

a lid;

a first container;

a second container;

an extraction mechanism;

an actuation mechanism;

a twist locking mechanism;

the first container comprises a lid-receiving open end and an outlet-receiving open end;

the second container comprises an inlet-receiving open end and a closed base end;

the extraction mechanism comprises an inlet, an outlet, and a push pump;

the actuation mechanism comprises a first interface, a second interface, a first sleeve, and a second sleeve;

the push pump comprises a plunger, a fluid transfer chamber, and a one-way valve;

the lid being detachably and adjacently connected to the first container, at the lid-receiving open end;

the first interface being detachably and adjacently connected to the first container, at the outlet-receiving open end;

the outlet traversing through the outlet-receiving open end and into the first container;

the second interface being detachedly and adjacently connected to the second container at the inlet-receiving open end;

the inlet traversing through the inlet-receiving open end and into the second container;

the first sleeve being telescopically engaged into the second sleeve;

the first interface being positioned opposite to the second sleeve along the first sleeve;

the second interface being positioned opposite to the first sleeve along the second sleeve;

the actuation mechanism being mechanically integrated into the extraction mechanism, wherein the actuation mechanism is used to activate the extraction mechanism;

the first sleeve being fixed about the plunger;

the plunger being slidably engaged into the fluid transfer chamber;

the second sleeve being fixed about the fluid transfer chamber;

the inlet being in fluid communication with the fluid transfer chamber;

the outlet being in fluid communication the fluid transfer chamber through the one-way valve; and the twist locking mechanism being operatively integrated between the first sleeve and the second sleeve, wherein the twist locking mechanism is used to lock the first sleeve and the second sleeve by rotating the twist locking mechanism in one direction and is used to unlock the first sleeve and the second sleeve by rotating the twist locking mechanism in an opposite direction.

18. The container for mixing two stored fluids as claimed in claim 17 comprises:

the lid comprises a main body, a spout, a mouthpiece hole, a seal, a lid transfer channel, and a straw;

the spout being hingedly and adjacently connected to the main body, opposite the lid receiving open end;

the mouthpiece hole traversing through the main body towards the first container;

the seal being layered onto and along the spout;

the lid transfer channel traversing through the main body towards the first container;

the mouthpiece hole and the lid transfer channel being positioned opposite to each other about the main body;

the straw being positioned within the first container;

the straw being detachably and adjacently connected to the main body; and the straw being in fluid communication with the lid transfer channel.

19. The container for mixing two stored fluids as claimed in claim 18 comprises:

wherein the spout is in a closed configuration;

the spout being situated along the main body; and the seal being pressed into the lid transfer channel and the mouthpiece hole.

20. The container for mixing two stored fluids as claimed in claim 18 comprises:

wherein the spout is in an open configuration;

the spout being angularly offset from the main body; and the spout being in fluid communication with the lid transfer channel.

* * * * *